US010739098B2

(12) United States Patent
Lee

(10) Patent No.: US 10,739,098 B2
(45) **Date of Patent: *Aug. 11, 2020**

(54) FIREARM ADAPTER

(71) Applicant: NSSIP LLC, Fort Myers, FL (US)

(72) Inventor: Darryl S. Lee, Fort Myers, FL (US)

(73) Assignee: NSSIP, LLC, Fort Myers, FL (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/252,957

(22) Filed: Jan. 21, 2019

(65) Prior Publication Data

US 2019/0154386 A1 May 23, 2019

Related U.S. Application Data

(63) Continuation of application No. 15/642,467, filed on Jul. 6, 2017, now Pat. No. 10,190,839, which is a continuation of application No. 15/499,430, filed on Apr. 27, 2017, now Pat. No. 10,066,890, application No. 16/252,957, filed on Jan. 21, 2019, which is a continuation of application No. 15/625,542, filed on Jun. 16, 2017, now Pat. No. 10,302,384, which is a continuation of application No. 15/499,430, filed on Apr. 27, 2017, now Pat. No. 10,066,890, and a continuation of application No. 15/601,528, filed on May 22, 2017, now Pat. No. 9,891,017.

(51) Int. Cl.

| | |
|---|---|
| ***F41A 21/32*** | (2006.01) |
| ***F41A 21/30*** | (2006.01) |
| ***F41A 21/44*** | (2006.01) |

(52) U.S. Cl.

CPC ..... *F41A 21/325* (2013.01); *F41A 21/30* (2013.01); *F41A 21/44* (2013.01)

(58) Field of Classification Search

CPC ..... F41A 21/30–42
USPC ..... 42/76.01; 181/223; 89/14.2–14.4
See application file for complete search history.

(56) References Cited

U.S. PATENT DOCUMENTS

| | | | | | |
|---|---|---|---|---|---|
| 2,351,037 | A * | 6/1944 | Green | F41A 21/34 | 89/14.5 |
| 2,453,747 | A * | 11/1948 | Egleson | F41A 21/42 | 42/79 |
| 2,466,104 | A * | 4/1949 | Hilburn | F41A 21/42 | 42/79 |
| 2,484,998 | A * | 10/1949 | Hutchinson | F41A 21/40 | 42/79 |
| 2,656,637 | A * | 10/1953 | Richards | F41A 21/42 | 42/79 |

(Continued)

*Primary Examiner* — Stephen Johnson
*Assistant Examiner* — Benjamin S Gomberg
(74) *Attorney, Agent, or Firm* — Nicholas Pfeifer; Smith & Hopen, P.A.

(57) ABSTRACT

A fast-attaching, self-aligning, easily adaptable and tool-less firearm adapter. The novel adapter attaches to the barrel of a firearm while precisely aligning the barrel and adapter using a concentric constriction sleeve along the barrel and a longitudinal compression barrel guide at the muzzle. The device is adapted to attach to a wide range of barrel diameters via an easy to fit and inexpensive to manufacture fitment sleeve. Thus, the adapter can be manufactured in a single size and work with most firearms. In addition, the device attaches to the smooth section of barrel thereby eliminating the need for permanently modifying a firearm by threading the barrel.

20 Claims, 16 Drawing Sheets

(56) References Cited

U.S. PATENT DOCUMENTS 2,676,429 A * 4/1954 Gotterson ..... F41A 21/40 42/79
2,696,995 A * 12/1954 Schacht ..... F41A 21/40 285/392
2,866,288 A * 12/1958 Herter ..... F41A 21/42 42/79
2,883,781 A * 4/1959 Harvey ..... F41C 27/06 42/105
2,968,111 A * 1/1961 Welles ..... F41A 21/42 42/79
2,977,702 A * 4/1961 Ewald ..... F41A 21/40 42/79
2,989,815 A * 6/1961 Hare ..... F41A 21/42 42/79
3,166,865 A * 1/1965 Grahn ..... F41A 21/40 42/79
3,710,679 A * 1/1973 Werbell, III ..... F41A 21/30 89/14.4
3,776,093 A 12/1973 Leverance et al.
3,797,155 A * 3/1974 Smith ..... F41A 21/42 42/79
4,663,875 A 5/1987 Tatro
4,939,977 A 7/1990 Stroup
5,020,416 A * 6/1991 Tripp ..... F41A 21/38 89/14.3
6,769,346 B2 8/2004 Rosenthal
6,973,863 B1 * 12/2005 Jones ..... F41A 21/26 89/14.2
7,836,809 B2 * 11/2010 Noveske ..... F41A 21/34 89/14.2
8,186,261 B2 * 5/2012 McNeill ..... F41A 21/38 181/223
8,973,481 B2 * 3/2015 Dueck ..... F41A 21/325 181/223
9,927,201 B2 * 3/2018 Penchuk ..... F41A 21/325
10,066,890 B1 * 9/2018 Lee ..... F41A 21/325
10,082,355 B2 * 9/2018 Addis ..... F41A 21/325
2003/0182838 A1 10/2003 Kessler
2009/0193963 A1 * 8/2009 Poulsen ..... F41A 21/30 89/14.2
2012/0167435 A1 7/2012 Poling
2018/0038663 A1 * 2/2018 Larue ..... F41A 3/66
2018/0058791 A1 * 3/2018 Larue ..... F41A 21/30

* cited by examiner

FIREARM ADAPTER

CROSS-REFERENCE TO RELATED APPLICATIONS

This nonprovisional application is a continuation of and claims priority to nonprovisional application Ser. No. 15/642,467, entitled "FIREARM BARREL ALIGNMENT GUIDE," filed Jul. 6, 2017 by the same inventor, which is a continuation of and claims priority to nonprovisional application Ser. No. 15/499,430, now U.S. Pat. No. 10,066,890, entitled "FIREARM SUPPRESSOR ADAPTER," filed Apr. 27, 2017 by the same inventor.

This nonprovisional application is also a continuation of and claims priority to nonprovisional application Ser. No. 15/625,542, entitled "FIREARM BARREL FITMENT SLEEVE AND METHOD OF USE," filed Jun. 16, 2017 by the same inventor which is a continuation of and claims priority to nonprovisional application Ser. No. 15/499,430, now U.S. Pat. No. 10,066,890, entitled "FIREARM SUPPRESSOR ADAPTER," filed Apr. 27, 2017 by the same inventor, and is also a continuation of and claims priority to nonprovisional application Ser. No. 15/601,528, now U.S. Pat. No. 9,891,017, entitled "FIREARM SUPPRESSOR ADAPTER," filed May 22, 2017 by the same inventor.

BACKGROUND OF THE INVENTION

1. Field of the Invention

This invention relates, generally, to firearms adapters. More specifically, it relates to a universal adapter for firearm muzzle devices, such as suppressors.

2. Brief Description of the Prior Art

Most gun shots produce sound that exceeds 140 dB, which can cause immediate and irreparable hearing loss to the gun operate and also significantly contributes to sound pollution. The effects of gun-fire noise are evidenced by the prevalence of hearing damage among veterans, law enforcement, and older individuals that have been around unsuppressed gunfire. Fortunately, there are muzzle devices referred to as "firearm suppressors" or "silencers" capable of reducing the gun-fire noise to a safe hearing range below 140 dB.

The primary functions of a suppressor are to trap, intercept, contain, disrupt, slow and/or redirect the expanding gas of the muzzle blast of a firearm. This allows the gas to slow and dissipate prior to exiting the muzzle of the suppressor. When gas is allowed or forced to slow and cool, the report of the gunshot is lowered to a non-damaging level. The longer the gas stays in the suppressor, the more the heat dissipates, and in turn, less sound in produced.

Up to now, in spite of the obvious health and societal benefits of suppressor use, a suppressor could not easily be fitted to most firearms without using inflexible, narrowly sized, mostly unavailable, and possibly damaging adapters; or without having the gun barrel cut and machined by a gunsmith on a lathe.

There are a few current methods for attaching a suppressor to a non-threaded barrel of a firearm. Among other problems, these methods can be time consuming, imprecise, and damaging to the gun. Most importantly, however, they are inflexible and only work with a very narrow range of firearms with a similar barrel diameter, barrel geometry, and location of barrel protrusions.

The most common method for attaching a suppressor to a non-threaded barrel firearm, is to hire a gunsmith to machine threads onto the barrel. Unfortunately, this process permanently alters the firearm. Many gun enthusiasts are unwilling to alter the factory dynamics of their firearm. It will never be original after this process, which can negatively affect the value of some guns. This process can also be costly and time consuming. For example, the process typically includes:

1. Finding a gunsmith that cuts barrel threads, which is often difficult because the gunsmith profession is a dying trade. There are also new government regulations requiring gunsmiths to register with ITAR and pay a $2,250 tax. The gunsmith profession is a low profit business for many and this new regulation, if not repealed, will cause some to drop out of the profession.
2. The next step includes a federally licensed dealer logging the gun into his/her acquisitions and dispositions book. There are many gun enthusiasts that become dissuaded from using gunsmiths because of this gun logging step.
3. Next, the gunsmith has to disassemble the gun and then use a lathe to precisely carve threads into the barrel at a specific size and tolerance. This is important because the threads can be cut in 7 or 8 different configuration. The gun is only able to mount a suppressor having the exact thread size and thread turn that corresponds to the threads cut into the barrel. In addition, a gunsmith only has one opportunity to correctly thread the barrel. The changes are permanent and cannot be fixed.
4. Finally, the gunsmith has to reassemble the gun and then the gunsmith or federally licensed dealer has to log the gun out of their acquisitions and dispositions book.
5. In addition, had the gun owner needed to send the barrel to an out of town gunsmith, the gun owner must perform the extra steps of disassembling the gun, finding the proper means for mailing the barrel, and reassembling the gun when the barrel is returned.

Alternatively, a suppressor can be secured to a gun using of one of the existing adapter systems listed below:

1. A set screw system manufactured to a certain diameter for a particular firearm. This system is intended to slide onto the end of the muzzle and tightened thereto using set screws. Unfortunately, these adapters require specific tools to tighten the set screws and said set screws can damage the barrel when tightened. Moreover, this system is not consistently centered to the muzzle due to the fluctuations in barrel size. This size difference in barrels can be found even within the same gun model from one year to the next. Furthermore, barrel diameter is measured in hundredths or thousandths of an inch. To manufacture and stock an adapter that can fit every barrel from 0.5 to 1 inch, even if only measuring to the hundredths, would take 50 different sizes. Finally, this method is not recommended for tapered barrels, which are prevalent in a majority of long guns. When you add other geometrical differences like tapered verses straight barrels, barrels with iron sights verses unobstructed barrels, and barrels with and without shrouds, there are thousands of different barrel types requiring thousands of versions of this adapter. The manufacturing cost, packaging cost and inventory cost is prohibitive, which is why the set screw-style adapter is typically only manufactured for a few barrels.
2. A bolt-on an adapter manufactured for an exact barrel size. This adapter style is manufactured for straight barrels or barrels with obstructions. This method is not recommended for tapered barrels. The adapters are usually manufactured for specific gun models due to the expense of machining and inventorying all of the different sizes required to fit other models. This adapter requires tools and time to install. When you consider other geometrical differences like barrels with iron sights and barrels with shrouds, it is clear that this style of an adapter is a custom adapter incapable of attaching to a variety of gun barrels.

3. A very limited suppressor adapter is designed to mount to a barrel nut on an AR platform gun. The barrel nut adapter fits one barrel and only one style of gun. Similar to the other options, this system requires tools and time to install.
4. Another option is attaching an adapter to the iron sights at the end of a barrel. This is not a recommended method to install anything on a gun, let alone, a suppressor that has a large amount of longitudinal force pulling against the sight when the gun is fired. The iron sight has to be a certain distance from the muzzle of the gun due to the specific groove length cut into the adapter for fitment to the iron sight. To install this adapter on a different gun, the iron sights would have to have the same measurement from the muzzle to the rear of sight and the same barrel diameter. Similar to the other methods, each version of this adapter is made for a particular gun and lacks the ability to fit different gun models.
5. Finally, there is a method of attaching the adapter to a groove or grooves in the flash hider of an AR style platform gun with a certain size and style flash hider at the end of the barrel. This adapter is only usable for one style of gun where the distance between the muzzle and the groove on the flash hider is the same. The lack of variability occurs because the engagement of the adapter fins into the flash hider groove is achieved at a set distance from the muzzle. The length between the muzzle and the grove is not adjustable and, therefore, this style adapter it is not adaptable to other guns.

All of these methods have drawbacks and problems that prevent the respective adapters from being widely adopted. Accordingly, what is needed is a firearm adapter that can overcome all of the problems listed above, providing an easy-to-use, adapter that can quickly, accurately, securely, and concentrically attach a muzzle device, such as a suppressor or a muzzle device extension to the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an easy-to-use, adapter that can quickly, accurately, securely, and concentrically attach a muzzle device such as a suppressor or muzzle device extension to the barrel of a variety of firearms is now met by a new, useful, and nonobvious invention.

In an embodiment, the novel structure includes a first sheath rotatably secured to a second sheath. A constricting sleeve at least partially resides within the first sheath and is integrated into or mechanically fixed to the second sheath in a non-rotational manner. A compression collar is disposed between the constricting sleeve and the first sheath or radially integrated with the first sheath.

The constricting sleeve has a first end, a second end, and a flexible body extending therebetween. In an embodiment, the constricting sleeve has tubular cross-section establishing an outer surface and an inner surface. The inner surface has a smaller diameter than the outer surface, and the outer surface has a tapered design along the longitudinal axis of the constricting sleeve. As such, the diameter of the outer surface proximate the first end is less than the diameter of the outer surface proximate the second end.

In an embodiment, the first end of the constricting sleeve has a plurality of flexible arms establishing a discontinuous circumference at the first end of the constricting sleeve, such that the plurality of flexible arms is capable of compressing towards the longitudinal axis to reduce the inner diameter of the constricting sleeve. An embodiment may also or independently include the second end having a plurality of slots establishing a discontinuous circumference at the second end of the constricting sleeve. The slots are designed to interconnect a force transferring collar having a plurality of fins extending in an axial direction. The force transferring collar is in mechanical communication with the second sheath. The interconnection of the plurality of fins and the plurality of slots thereby prevents rotation of the restricting sleeve with respect to the force transferring collar, and in turn, the second sheath.

In an embodiment, the compression collar is in threaded communication with the first sheath, but rotationally fixed with respect to the constricting sleeve. The compression collar includes a first end and a second end with a tubular cross-section establishing an outer surface and an inner surface. The inner surface has a smaller diameter than the outer surface, and the inner surface is a tapered along the extent of the collar. As a result, the diameter of the inner surface near the first end is less than the diameter of the inner surface near the second end.

The constricting sleeve and the compression collar are inversely oriented with respect to each other, such that the tapered outer surface of the constricting sleeve increases in diameter in a first direction and the tapered inner surface of the compression collar increases in diameter in the same direction. Therefore, movement of the compression collar in the first direction produces a downward force on the constricting sleeve as the second end of the compression collar, the end with a lesser inner diameter, moves towards the second end of the constricting sleeve, the end with a greater outer diameter.

An embodiment also includes a barrel guide concentrically aligned with the constricting sleeve. In an embodiment, the barrel guide is in structural communication with the second sheath. In any embodiment, the barrel guide includes an aperture concentrically aligned with the constricting sleeve, thereby providing a passage for a bullet leaving the barrel of the firearm. The barrel guide further includes curved or angled walls having a first end near the aperture and extending in an aft direction, such that a distance between the walls increases towards the aft direction. As a result, an axial force causing the barrel of the firearm to contact the barrel guide will funnel the barrel into axial alignment with the aperture.

An embodiment includes a flexible fitment sleeve having an incomplete tubular shape resulting in an adjustable diameter. The fitment sleeve is relied upon for effectively increasing the barrel diameter to allow a single adapter to work with any barrel diameter. The fitment sleeve may have a tapered design to account for tapered barrels. In addition, the fitment sleeve may incorporate the barrel guide.

An embodiment includes a muzzle device/suppressor attachment extending from the second sheath in an axial direction away from the first sheath and in concentric alignment with the aperture in the alignment guide. The suppressor attachment has external threads on which a muzzle device/suppressor can be secured. Alternatively, the second sheath may be axially integrated into a muzzle device/suppressor or muzzle device/suppressor extension.

An object of the invention is to provide a muzzle device/suppressor adapter configured to fit most firearms on the market.

An object of the invention is to provide a tool-less, easy-to-use, adapter that can quickly, accurately, securely, and concentrically attach a muzzle device/suppressor or muzzle device/suppressor extension to the barrel of a firearm.

It is another object of the invention to provide a muzzle device/suppressor adapter that is far less costly to manufacture due to a one size fits all system, and to eliminate the need to manufacture hundreds of sizes and configurations.

In addition, it is an object of this invention to provide an adapter, which can be secured to or integrated with a muzzle device/suppressor and/or a muzzle device/suppressor extension; and provide an adapter that has the ability to attach to one or multiple firearm accessories, including, but not limited to a bipod, an iron sight, a sling mount, a rail for mounting accessories, a hand guard for installation from barrel heat, a forward grip, a flashlight, and a laser.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a firearm adapter configured to fit most gun barrel. The adapter preferably attaches to the smooth section of a barrel and doesn't require any tooling or permanent modification to the barrel for securement of the adapter to a firearm. The ability of the present invention to attach to a variety of gun barrels reduces the costs associated with manufacturing, packaging, labeling, and stocking because a single adapter of the present invention can replace thousands of different muzzle device/suppressor and muzzle device/suppressor adapter designs. The following description will reference suppressors and integrated suppressors in place of any muzzle devices, however, the adapters described herein will work with any firearm accessories generally designed to attach or extend from a muzzle end of a firearm, which are referred to herein as muzzle devices.

Figure 1:
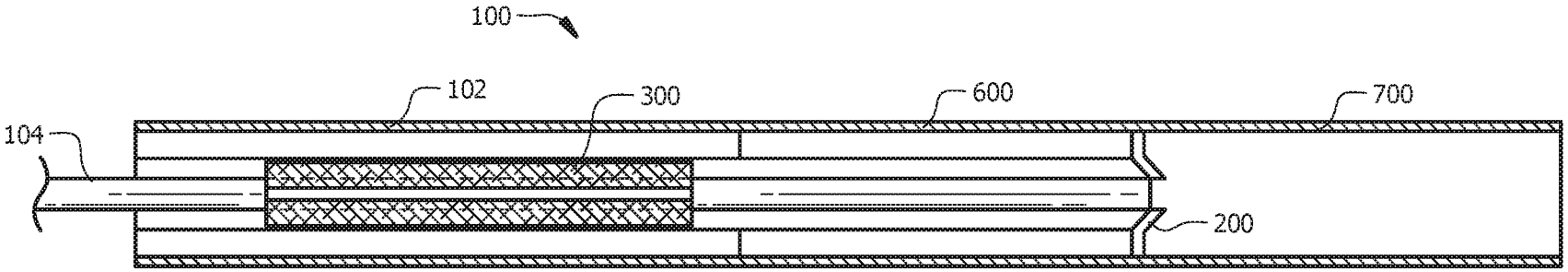
FIG. 1 is a sectional elevation view of an embodiment of the present invention.

As shown in FIG. 1, an embodiment of firearm adapter 100 includes an attachable or integrated suppressor 700 and/or suppressor extension 600. Adapter 100 is configured to ensleeve and easily compress around barrel 104. An embodiment may include fitment sleeve 300 to effectively increase the diameter of barrel 104. As a result, adapter 100 can establish a proper amount of compression force around barrel 104 to ensure that adapter 100 remains fixed to barrel 104 during use of the firearm.

Figure 2:
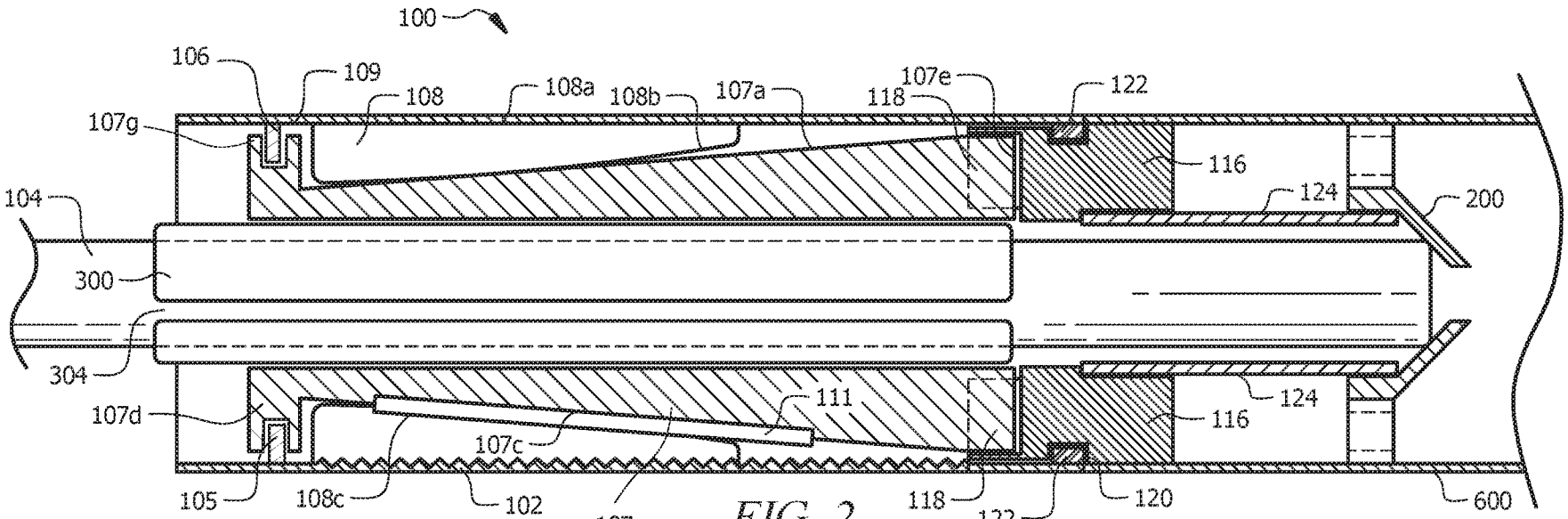
FIG. 2 is a sectional elevation view of an embodiment of the present invention highlighting the internal mechanisms of the adapter.

Referring now to FIG. 2, an embodiment of adapter 100 includes first sheath 102 housing a generally cylindrical, but tapered compression collar 108 and at least partially housing a generally cylindrical, but tapered constricting sleeve 107. Compression collar 108 is sandwiched between sheath 102 and constricting sleeve 107. Moreover, first sheath 102 is in rotational communication with second sheath 103, an integrated suppressor 700, or an integrated suppressor extension 600. The latter is depicted in FIG. 2.

Figure 3:
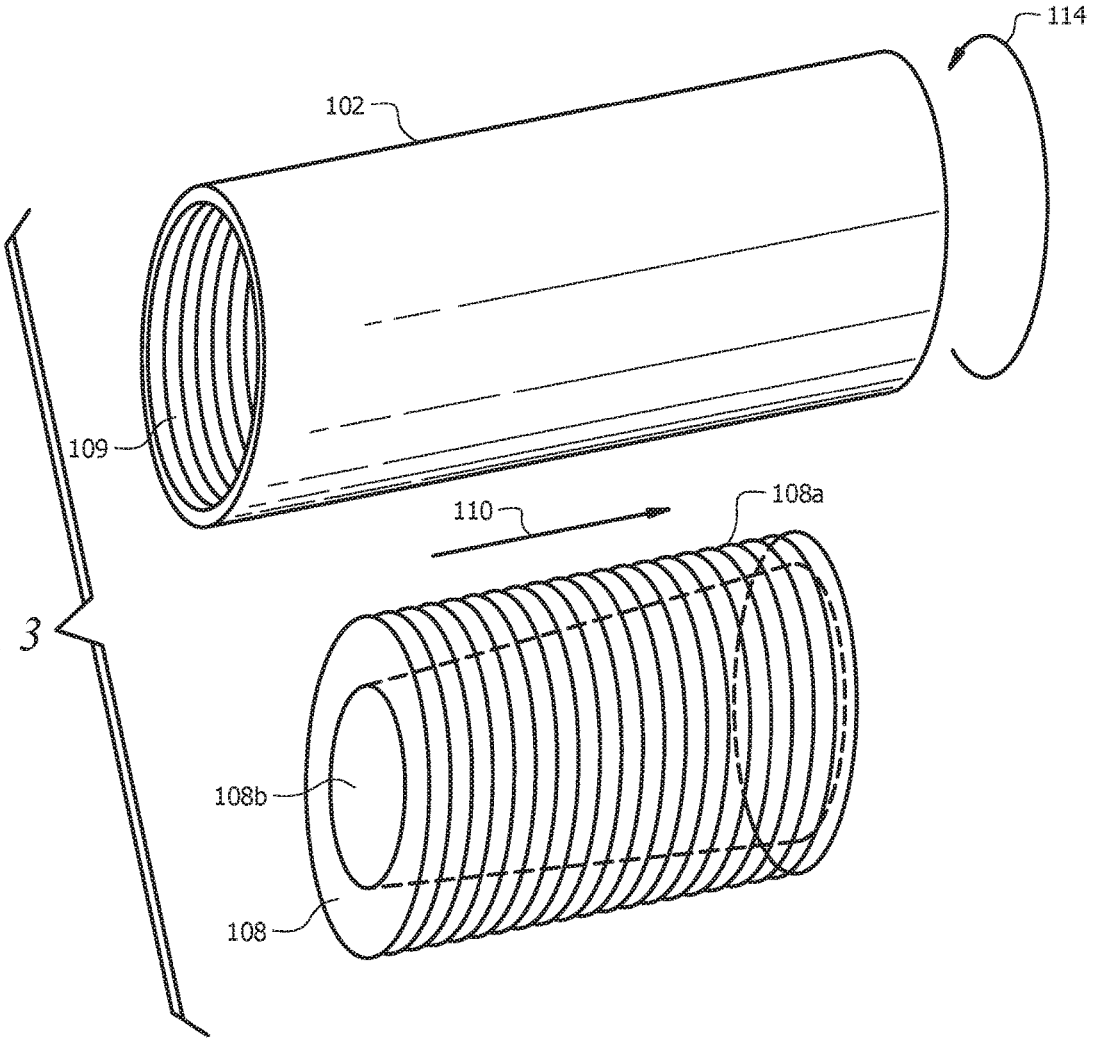
FIG. 3 is an exploded view of an embodiment of the present invention showing the outer rotatable sheath and the compression collar.

As depicted in FIGS. 2-3, an embodiment of first sheath 102 includes threaded internal surface 109. Outer surface 108*a* of compression collar 108 is inversely threaded with respect to internal surface 109 and in contact with said surface, such that rotation of first sheath 102, as depicted by arrow 114, causes linear translation of compression collar 108 in a direction parallel to the longitudinal axis of adapter 102, as depicted by arrow 110. It should be noted that while threads are circumferentially present on internal surface 109, the threads are not shown on the top half in FIGS. 2 and 5 to provide an additional level clarity.

Figure 4:
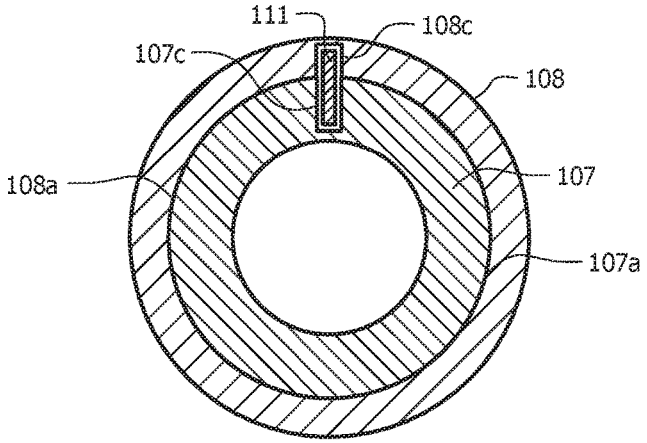
FIG. 4 is a cross-sectional view an embodiment of the present invention highlighting the key residing within the key slots of the compression collar and the constricting sleeve.

As best depicted in FIG. 4, compression collar 108 further includes key slot 108*c* disposed in internal surface 108*b*. Key slot 108*c* is radially aligned with key slot 107*c* in outer surface 107*a* of constricting sleeve 107. In conjunction, key slots 107*c*, 108*c* received key 111. Key 111 prevents rotation of compression collar 108 with respect to constricting sleeve 107. Prevention of rotation of compression sleeve 108 with respect to constricting sleeve 107 helps compression collar 108 to travel in a linear direction when first sheath 102 is rotated.

In an embodiment, compression collar 108 is radially integrated into first sheath 102 and inner surface 108*b* of compression collar 108 is in threaded communication with outer surface 107*a* of constricting sleeve 107. This arrangement will also allow for the liner translation of compression collar 108 when sheath 102 is rotated.

Referring back to FIG. 2-3, inner surface 108*b* of compression collar 108 is tapered such that a second end (proximal end in FIGS. 2-3) has an inner diameter less than the inner diameter at the first end (distal end in FIGS. 2-3). Conversely, outer surface 107*a* of restricting sleeve 107 is tapered such that a first end (proximal end in FIGS. 2-3) has an outer diameter greater than the outer diameter at the second end (distal end in FIGS. 2-3). The direction of the taper of compression collar 108 and direction of the taper of constricting sleeve 107 are inversely oriented with respect to each other, such that tapered inner surface 108*b* of compression collar increases in diameter in a first direction (a distal direction in the embodiment shown in FIG. 2) and 108 tapered outer surface 107*a* of constricting sleeve 107 increases in diameter in the first direction.

The rotation of sheath 102 in a first direction (depicted by arrows 114 in FIG. 5), and the resulting linear travel of compression collar 108 in the first direction (a distal direction in the embodiment shown in FIG. 2, exemplified by arrow 110 in FIG. 5) produces a radial compression force (depicted by arrows 112) as compression collar 108 moves along outer surface 107*a* of constricting sleeve 107 towards distal end 107*e* of constricting sleeve 107. As compression collar 108 moves towards distal end 107*e* of constricting sleeve 107, the combined thickness of compression collar 108 and constricting sleeve 107 increases, and because sheath 102 is rigid, constricting sleeve 107 is forced inwardly towards the longitudinal axis of barrel 104. In other words, internal surface 107*b* of constricting sleeve 107 reduces in diameter compressing around barrel 104, or fitment sleeve 300 if used.

Figure 5:
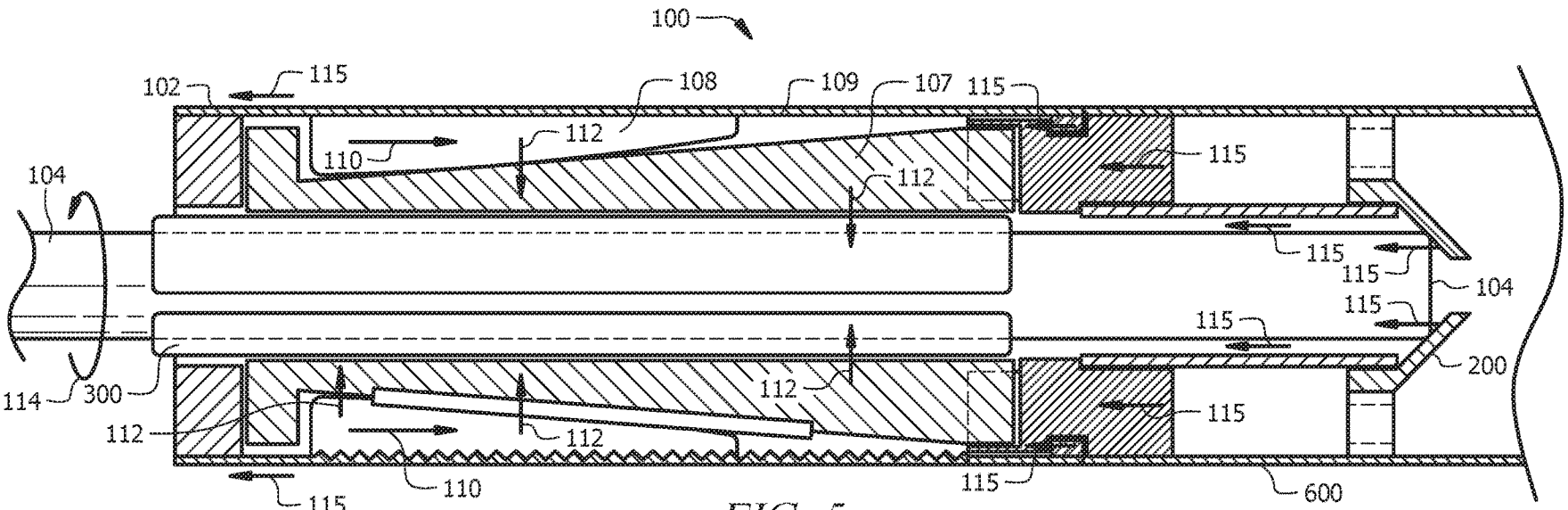
FIG. 5 is a sectional elevation view of an embodiment of the present invention highlighting the internal mechanisms of the adapter with force arrows.

Correspondingly, rotation of sheath 102 in a second direction, opposite the first, will result in compression collar 108 linearly traveling in a second direction—the proximal direction in the exemplified embodiments in FIGS. 2 and 5. The thicker portions of compression collar 108 and constricting sleeve 107 move away from each other and the compression force on barrel 104 and/or fitment sleeve 300 reduces in magnitude.

Constricting sleeve 107 is adapted to yield under compression force such that inner surface 107*b* reduces in diameter. Moreover, constricting sleeve 107 is adapted the return to its original shape upon the removal of compression force. Thus, constricting sleeve 107 is preferably made of a flexible yet resilient material.

Figure 6:
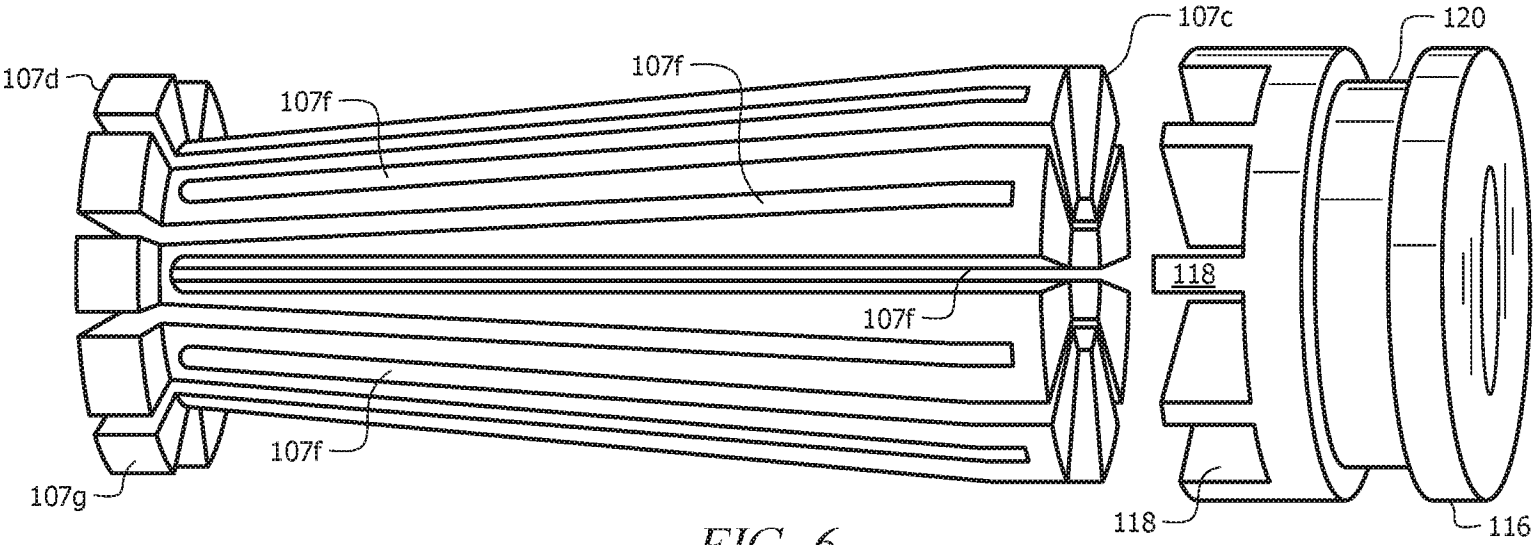
FIG. 6 is an exploded view of an embodiment of the present invention highlighting the constricting sleeve and the force transferring collar.

In an embodiment, as depicted in FIG. 6, constricting sleeve 107 has a discontinuous perimeter at both the proximal and distal ends 107*d*, 107*e*. The discontinuous nature is achieved through expansion/contraction adjustment slots 107*f*. Adjustment slots 107*f* preferably extend along the majority of the length of constricting sleeve 107 thereby providing the necessary circumferential gaps to reduce the diameter of constricting sleeve 107.

In an embodiment, proximal end 107*d* includes an outwardly extending annular flange 107*g*. Annular flange 107*g* works in conjunction with an inwardly projecting annular rim 106 near the proximal end of adapter 100 to prevent constricting sleeve 107 from exiting the proximal end of sheath 102. Annular rim 106 also has a central bore for receiving barrel 104, and fitment sleeve 300 if one is needed. As depicted in FIG. 2, Annular rim 106 is radially aligned with a portion of annular flange 107*g* and is adapted to insert into an annular groove in annular flange 107*g* to also help prevent constricting sleeve 107 from binding with force transfer collar 116. Alternatively, as depicted in FIG. 5, annular rim 106 is longitudinally spaced from constricting sleeve 106 providing a simple backstop to prevent constricting sleeve 107 from exiting the proximal end of sheath 102.

Figure 7:
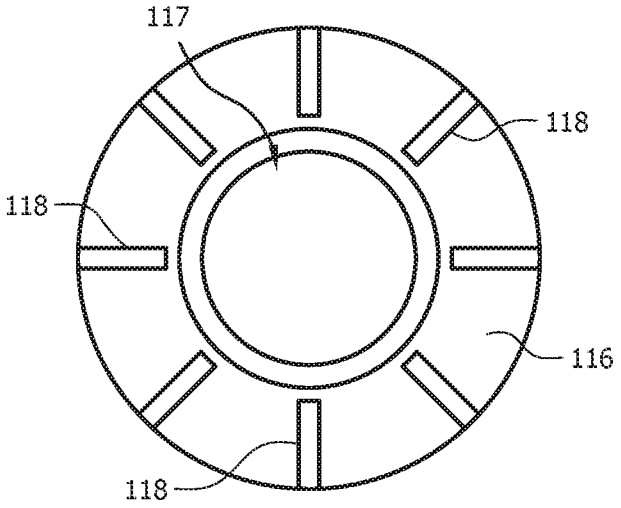
FIG. 7 is an end view of the force transferring collar.
Figure 8A:
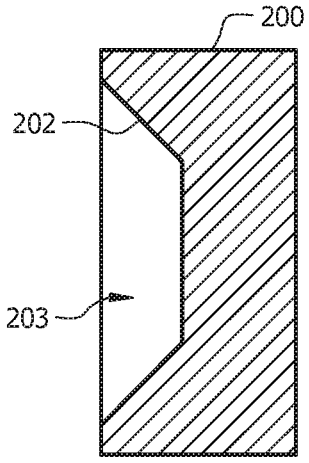
FIG. 8A is a side sectional view of an embodiment of the barrel guide.
Figure 8B:
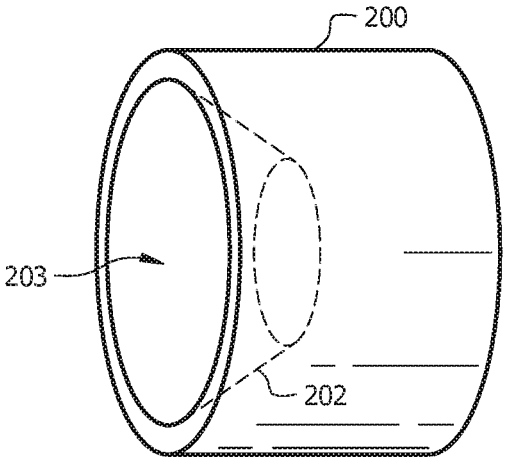
FIG. 8B is a perspective view of an embodiment of the barrel guide.
Figure 9A:
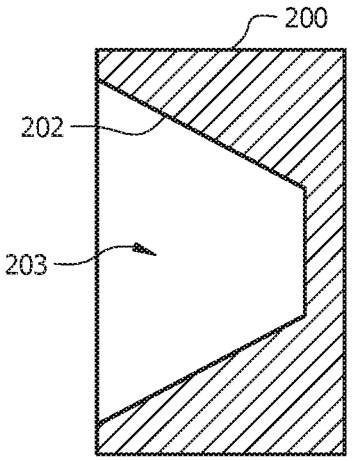
FIG. 9A is a side sectional view of an embodiment of the barrel guide.
Figure 9B:
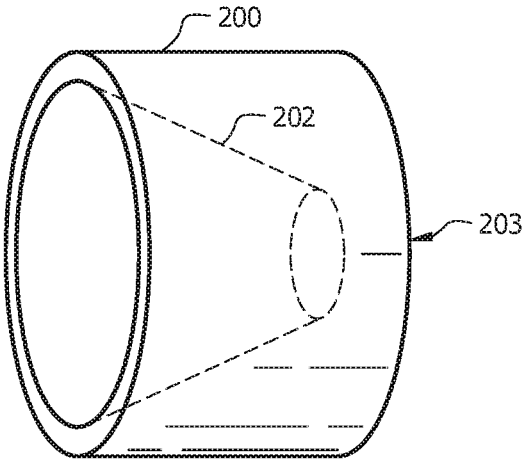
FIG. 9B is a perspective view of an embodiment of the barrel guide.
Figure 10:
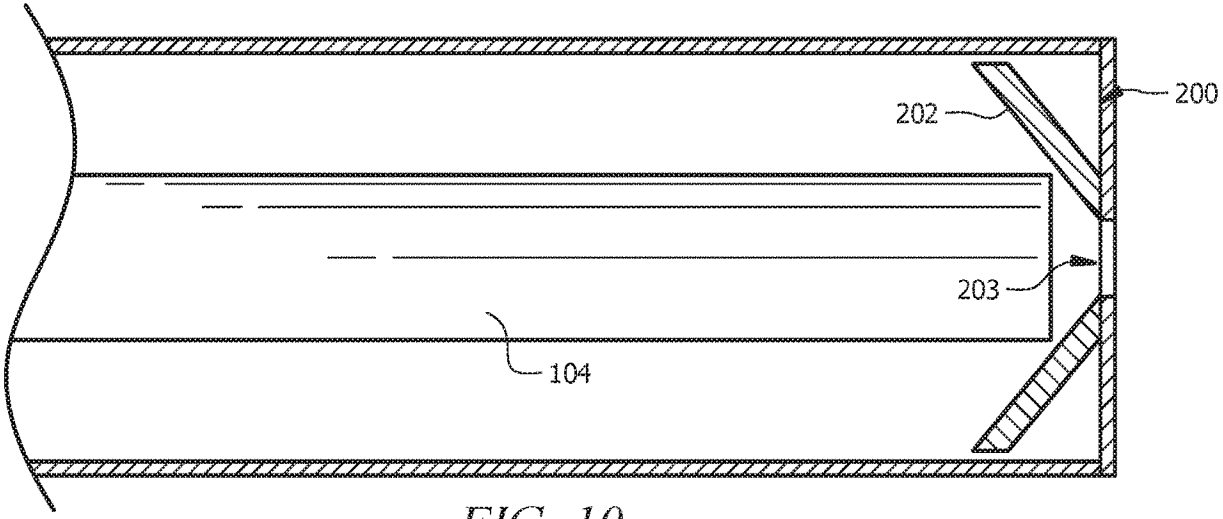
FIG. 10 is a side sectional view of an embodiment of the barrel guide secured within a second sheath.
Figure 11:
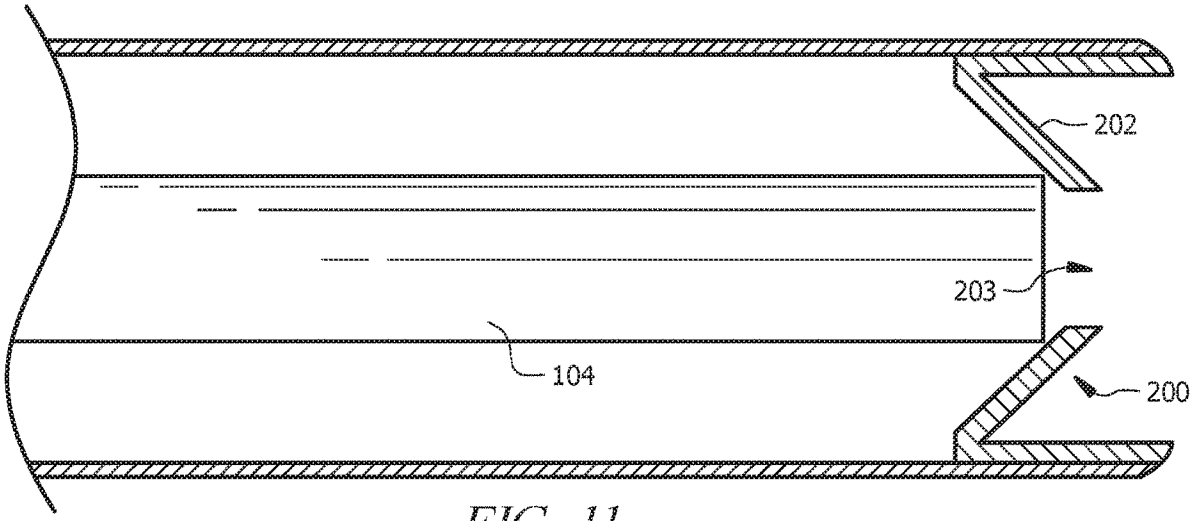
FIG. 11 is a side sectional view of an embodiment of the barrel guide secured within a second sheath.

In the exemplary embodiment in FIGS. 2 and 6, adjustment slots 107*f* serve an additional purpose. At distal end 107*e*, adjustment slots 107*f* receive flanges 118 extending from force transfer collar 116 in an axial direction, which is best depicted in FIGS. 6-7. Flanges 118, however, are preferably sized to avoid having a significant effect on the constricting sleeve's ability to radially compress.

Force transfer collar 116 is fixed to second sheath 103, an integrated suppressor 700, or an integrated suppressor extension 600 (the latter is depicted in FIG. 2). As a result, force transfer collar 116 is rotationally fixed with respect to second sheath 103, an integrated suppressor 700, or an integrated suppressor extension 600. The interconnection of flanges 118 and adjustment slots 107*f* in turn prevent rotation of constricting sleeve 107 with respect to second sheath 103, an integrated suppressor 700, or an integrated suppressor extension 600; and key 111 prevents rotation of compression collar 108 with respect to constricting sleeve 107. Therefore, force transfer collar effectively prevents rotation of compression collar 108 when sheath 102 is rotated, which enables compression collar 108 to travel in a linear direction when sheath 102 is rotated.

As depicted in FIG. 7, force transferring collar 116 includes a central bore 117 sized to receive barrel 104. Preferably, force transferring collar 116 has an inner diameter equal to the inner diameter of constricting sleeve 107 when constricting sleeve 107 is free of any compression forces, i.e. in a position of repose.

Referring back to FIG. 2, an embodiment of force transferring collar 116 includes an annular notch 120 between flanges 118 and the distal end of force transferring collar 116. Annular notch 120, preferably freely, receives retention ring 122 secured to sheath 102. Retention ring 122 in combination with annular notch 120 keeps sheath 102 rotationally secured to second sheath 103, an integrated suppressor 700, or an integrated suppressor extension 600. Retention ring 122 may include or be comprised of bearings to reduce the friction during rotation of sheath 102.

An embodiment of adapter 100 may also include barrel guide 200. As illustrated in FIG. 2, barrel guide 200 may be in mechanical communication with force transferring collar 116 through structural member 124 and/or may be secured directly to second sheath 103, an integrated suppressor 700, or an integrated suppressor extension 600.

Barrel guide 200 allows a user to quickly and efficiently install and align adapter 100 to gun barrel 104. Barrel guide 200 is adapted to guide the muzzle into alignment with second sheath 103, an integrated suppressor 700, or an integrated suppressor extension 600 using, for example, distally and inwardly angled walls 202. Walls 202 extend inwardly enough to catch the muzzle of barrel 104 without extending far enough towards the longitudinal axis to impede a bullet exiting barrel 104.

As depicted in FIGS. 8-11, barrel guide 200 preferably has a frustoconical-shaped bore 203 to guide barrel 104, but may have any curved or angled walls shaped to funnel barrel 104 towards central bore 203 when subject to an axial force causing barrel 104 to contact barrel guide 200. Barrel guide 200 can be as simple as a hollow cone shaped device built with various angles preferably between 10 and 80 degrees. Barrel guide 200, used in conjunction with the concentric tightening of constricting sleeve 107 results in an adapter perfectly aligned to the barrel of the firearm. No tools or extra effort are required.

Barrel guide 200 provides extreme flexibility in that it will align any size barrel that falls between the outside diameter of conical bore 203 and the inside diameter of conical bore 203. In an embodiment, barrel guide 200 may threadly engage and disengage or may be secured directly to structural member 124 and/or to second sheath 103, an integrated suppressor 700, or an integrated suppressor extension 600. This temporary attachment allows barrel guide 200 to be modified as need to provide a properly sized barrel guide 200 based on the barrel diameter. A single cone, however, will fall easily within the common minimum barrel size of 0.55 and the common maximum barrel size of 1.05.

Figure 12A:
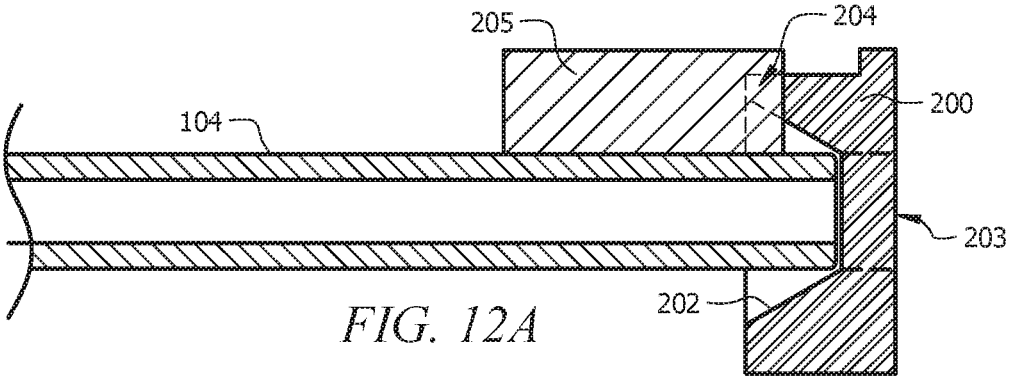
FIG. 12A is a side sectional view of an embodiment of the barrel guide with a cutout for iron sights.
Figure 12B:
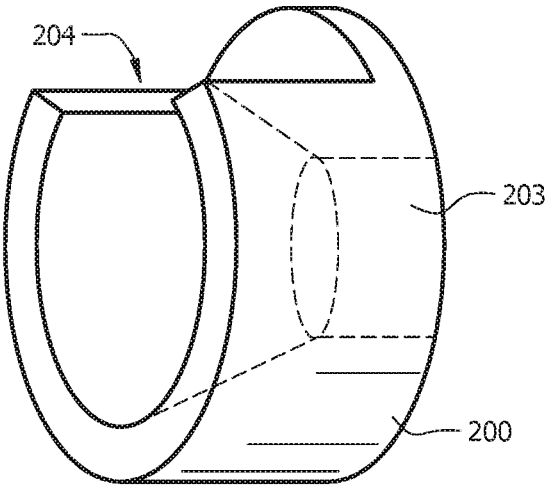
FIG. 12B is a perspective view of an embodiment of the barrel guide with a cutout for iron sights.
Figure 12C:
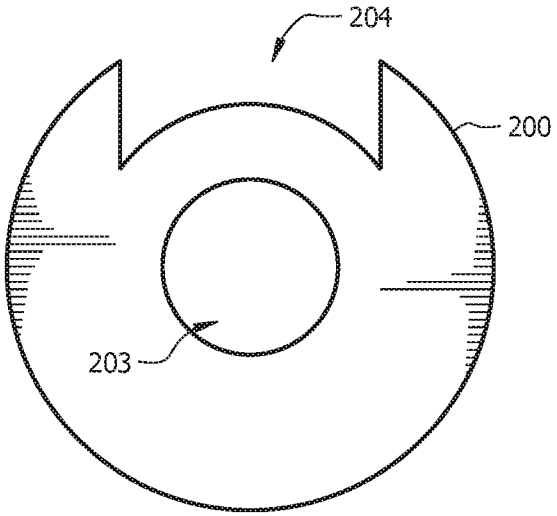
FIG. 12C is an end view of an embodiment of the barrel guide with a cutout for iron sights.
Figure 13:
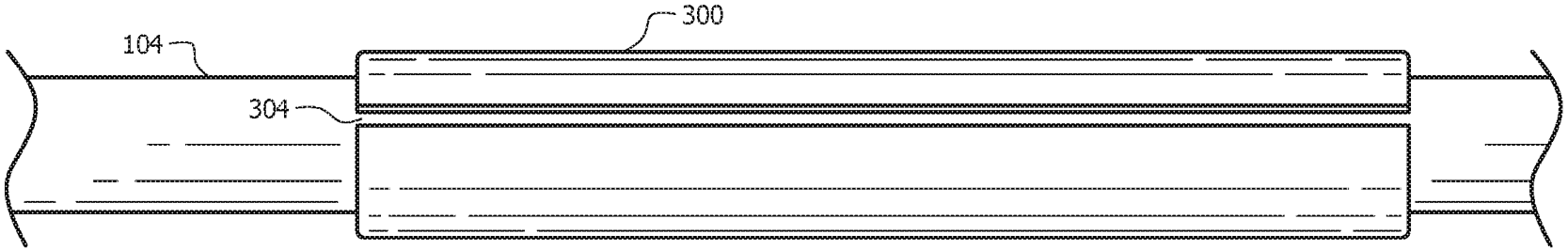
FIG. 13 is a side view depicting an embodiment of the fitment sleeve secured to a barrel.

Referring now to FIG. 12, an embodiment of barrel guide 200 includes cutout 204 for iron sights 205 in the proximal end of barrel guide 200. Such an embodiment preferably includes a vertical alignment indicator to inform a user of the location of the cutout 204 within second sheath 103, an integrated suppressor 700, or an integrated suppressor extension 600.

Barrel guide 200 comprises of a heat resistant, preferably flexible material for flexibly shaping to the muzzle. The flexibility helps form a tight seal with the muzzle. Alternatively, an embodiment may include a mechanical biasing member around the conical bore. As the cone is pushed against the muzzle, the spring compresses to form a tight seal and to facilitate perfect alignment. The spring can be placed in various positions and placements around the barrel guide to achieve compression. This seal is particularly important to prevent gas from escaping the suppressor and/or extension in a proximal direction and exiting the proximal end of outer sheath 102.

Barrel guide 200 can stand alone within adapter 100 or be integrated with the fitment sleeve, constricting sleeve, second sheath 103, an integrated suppressor 700, or an integrated suppressor extension 600.

Referring back to FIG. 5, barrel guide 200 also provides the necessary frontal stop to fix adapter 100 in place when adapter 100 is tightened around barrel 104. As sheath 102 is rotated in direction 114, compression collar 108 is forced towards distal end 107*e* of constricting collar 107 in accordance with directional arrow 110. The combined thickness of compression collar 108 and constricting sleeve 107 is met by internal surface 109 of sheath 102 and constricting sleeve 107 compresses in an inwardly direction depicted by directional arrows 112. After a certain amount of rotation of sheath 102, internal surface 107*b* of constricting sleeve 107 will compress into barrel 104, or fitment sleeve 300. Once constricting sleeve 107 and compression collar 108 can no longer move radially due to the compression force, further rotation of outer sheath 102 in accordance with rotational arrow 114 will cause outer sheath 102 to translate in the proximal direction, opposite of the direction of travel of compression collar 108, as depicted by arrows 115. Retention ring 122 will in turn pull force transfer collar 116 according to directional arrows 115. Because force transfer collar 116 is in mechanical communication with barrel guide 200, either through structural member 124, second sheath 103, integrated suppressor 700, and/or integrated suppressor extension 600 (the latter is depicted in FIG. 5), barrel guide 200 will also be pulled in the proximal direction as depicted by arrows 115 until barrel 104 contacts barrel guide 200 to securely aligned barrel 104 with adapter 100. In other words, adapter 100 is a self-aligning adapter.

Referring now to FIGS. 13-17, fitment sleeve 300 provides an inexpensive and highly variable means for fitting a single size adapter to most firearms without having to modify barrel 104. Fitment sleeve 300 preferably includes self-adjusting gap 304 along the length of fitment sleeve 300. Gap 304 allows fitment sleeve 300 to adjust to fit a wider range of firearm barrels. Moreover, as constriction sleeve 107 adds pressure to fitment sleeve 300, gap 304 allows fitment sleeve 300 to adjust to manufacturing differences in barrel diameter of multiple tenths, hundreds and thousandths of an inch through the narrowing and widening of gap 304 without further effort on the part of the operator.

Figure 14A:
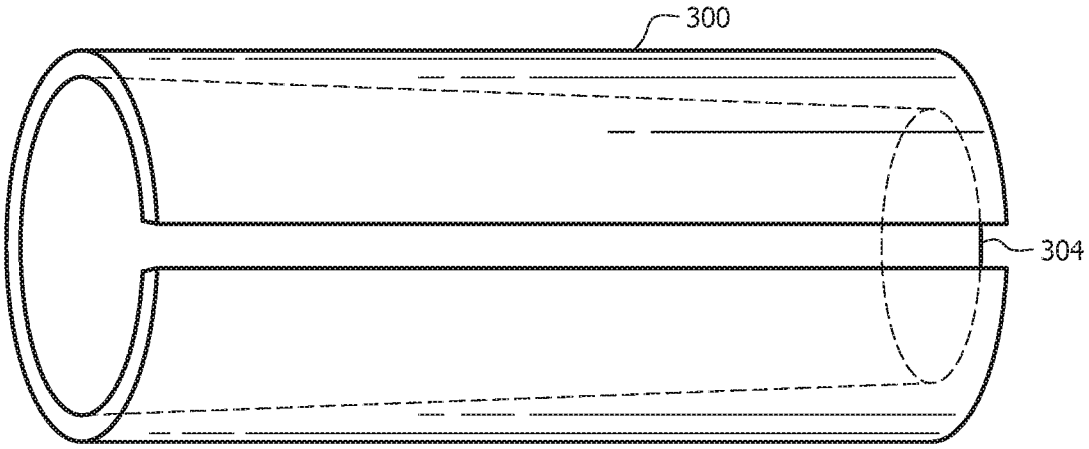
FIG. 14A is a perspective view depicting an embodiment of the fitment sleeve.
Figure 14B:
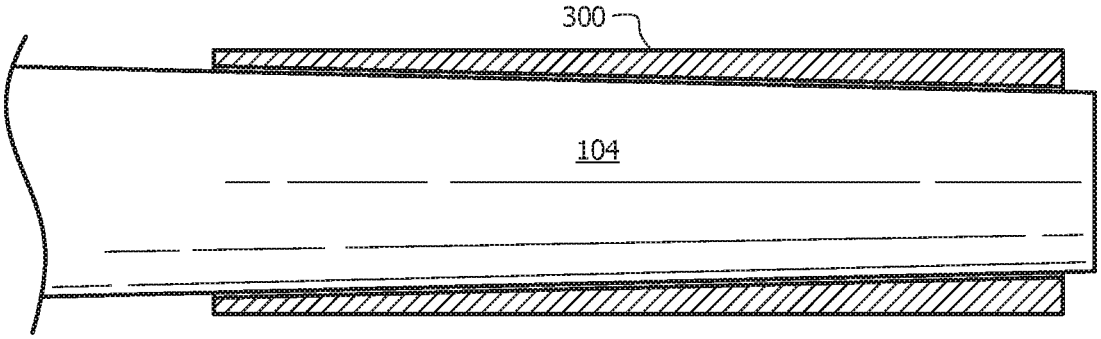
FIG. 14B is a side sectional view depicting an embodiment of the fitment sleeve secured to a barrel.

As depicted in FIG. 14, this same process is applicable for tapered barrels through a tapered version of fitment sleeve 300. In an embodiment, gap 304 may widen at the rear and narrow at the front to allow perfect fitment of adapter 100 to barrel 104.

Figure 15:
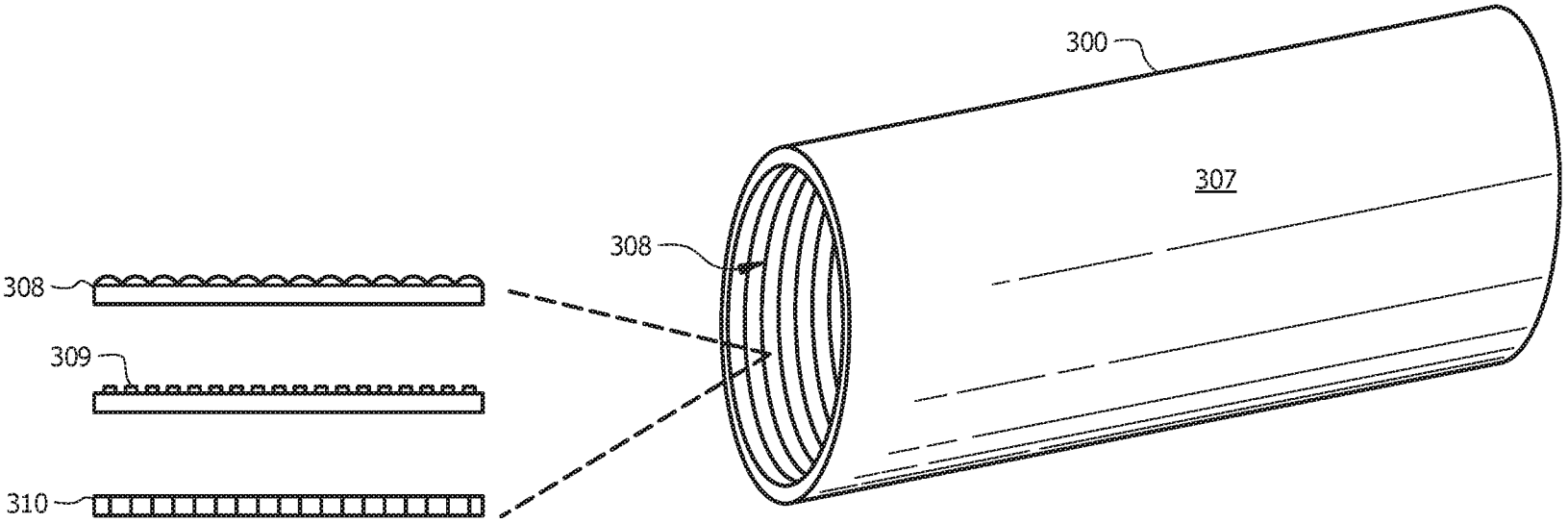
FIG. 15 is a perspective view depicting an embodiment of the fitment sleeve.

As depicted in FIG. 15, fitment sleeve 300 may further provide a secure gripping surface using e.g. grooves 308, ridges 309, or slits 310, on outer surface 307 and/or inner surface 308 of sleeve 300, for a more secure attachment of adapter 100 to a smooth metallic gun barrel.

Figure 16A:
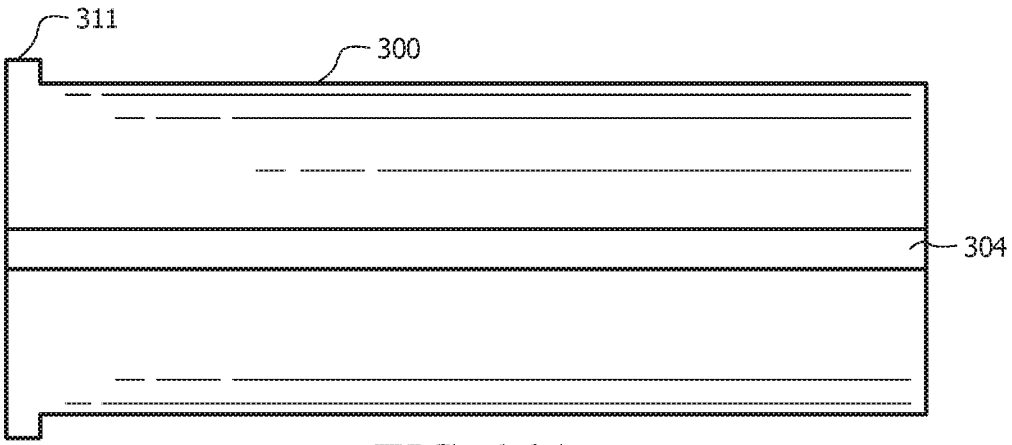
FIG. 16A is a side view depicting an embodiment of the fitment sleeve.
Figure 16B:
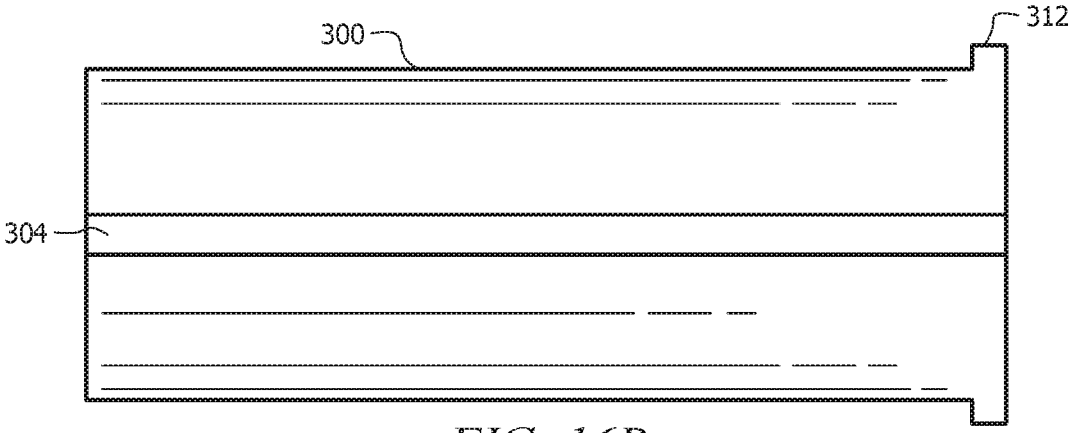
FIG. 16B is a side view depicting an embodiment of the fitment sleeve.

Referring now to FIG. 16, an embodiment may include annular stop 311 at the proximal end of fitment sleeve 300 to help secure the location of fitment sleeve 300 with respect to adapter 100. Alternatively, or in addition to, an embodiment may include annular stop 312 at the distal end of fitment sleeve 300 to help secure the location of fitment sleeve 300 with respect to adapter 100.

Figure 17:
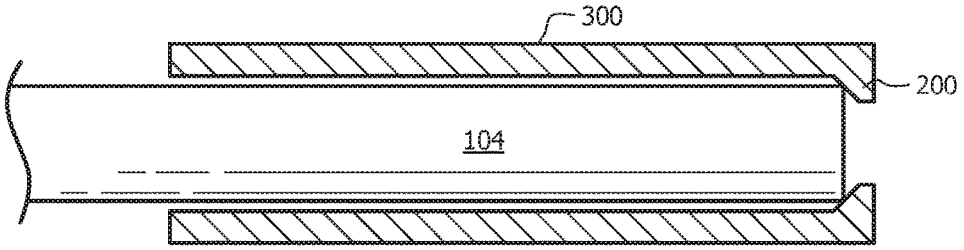
FIG. 17 is a side sectional view depicting an embodiment of the fitment sleeve secured to a barrel.

Referring to FIG. 17, an embodiment of fitment sleeve 300 may include barrel guide 200 integrated into the distal end of fitment sleeve 300 to help secure the location of fitment sleeve 300 with respect to adapter 100 while also aligning barrel 104 with adapter 100.

As depicted in FIG. 18, embodiments may integrate several parts to reduce the costs associated with manufacturing and assembly. An embodiment may include compression collar 108 radially integrated into or secured to sheath 102, such that the outer surface of compression collar 108*a* is the outer surface of sheath 102. A distal end of sheath 102 is in threaded communication with second sheath 103, an integrated suppressor 700, or an integrated suppressor extension 600 (the second sheath is depicted in FIG. 18).

Constricting sleeve 107 may be integrated into sheath 103 through the attachment or integration of distal end 107*e* to sheath 103. Proximal end 107*d* has a discontinuous perimeter achieved through expansion/contraction adjustment slots 107*f*. Adjustment slots 107*f* establish a plurality of free ends, which can flex under compression force to constrict around barrel 104. Adjustment slots 107*f* preferably extend along the length of constricting sleeve 107 thereby providing the necessary circumferential gaps to reduce the diameter of constricting sleeve 107. In addition, inner surface 107*b* is preferably curved to provide a more linear inner surface when compressed towards the longitudinal axis.

Barrel guide 200 is also integrated into sheath 103 by simply tapering the inner surface towards aperture 203. The embodiment further includes threaded suppressor attachment 702 on which a suppressor can be attached. Alternatively, suppressor 700, or suppressor extension 600 can be integrated with the distal end of sheath 103.

Figure 18A:
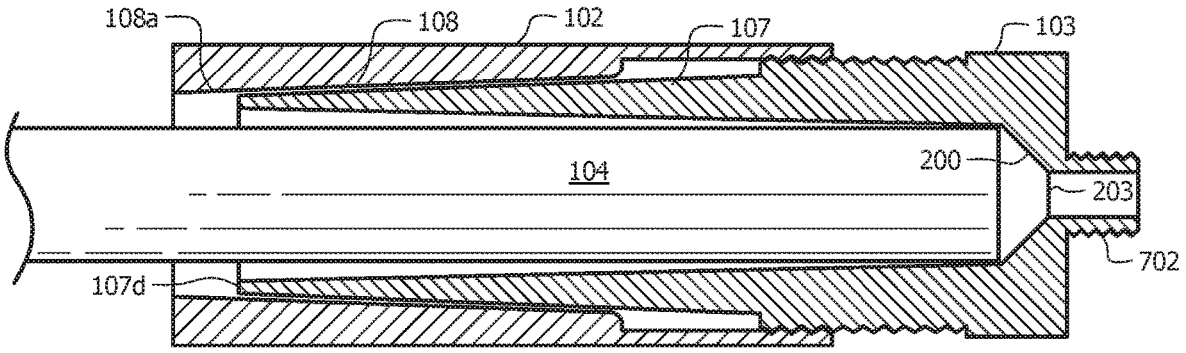
FIG. 18A is a sectional elevation view of an embodiment of the present invention highlighting the internal mechanisms of the adapter.
Figures 18B, 18C:
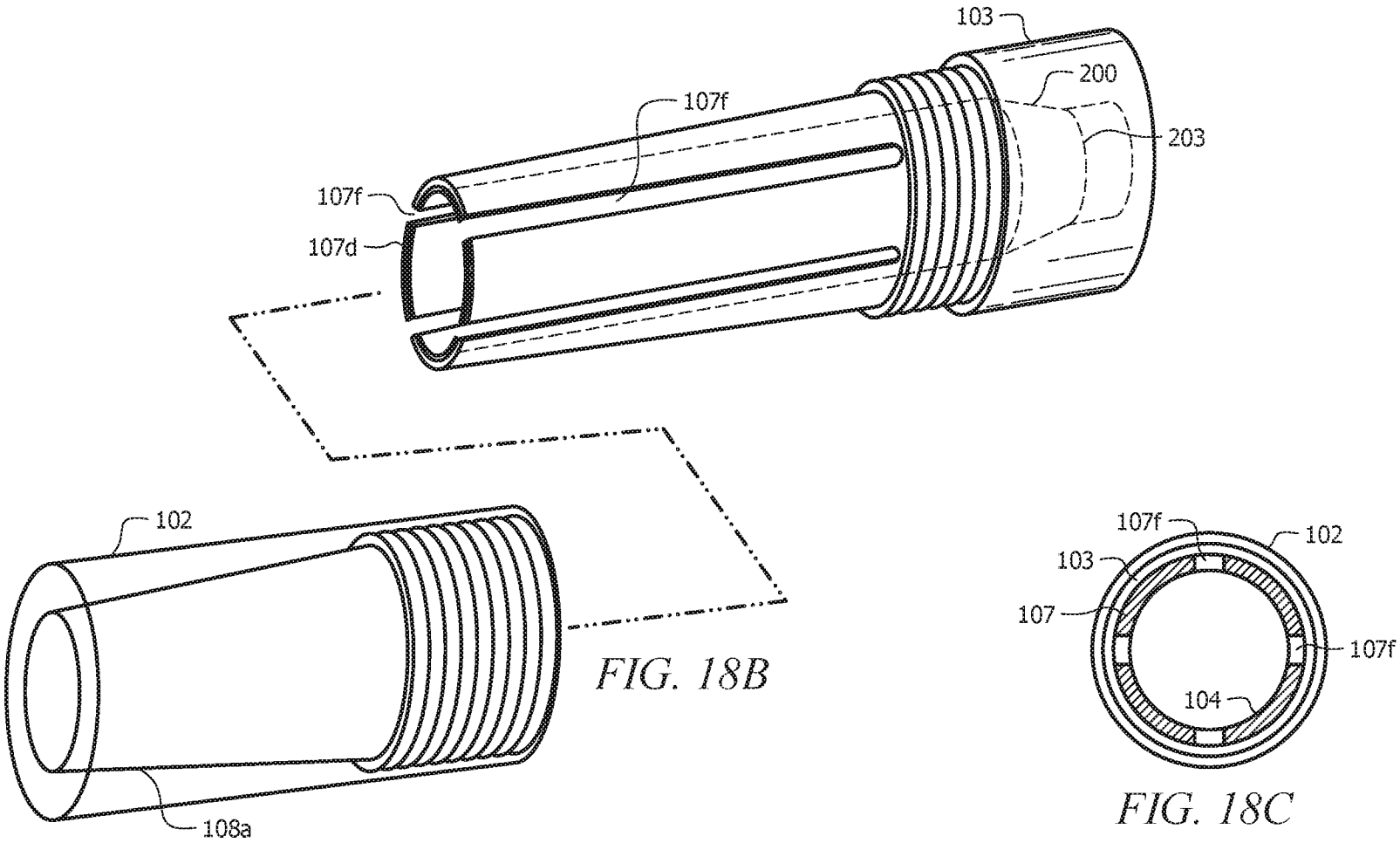
FIG. 18B is a partial exploded view of an embodiment of the present invention highlighting the connection between the first and second sheaths.
FIG. 18C is an end view of the embodiment in FIG. 18A.
Figure 18D:
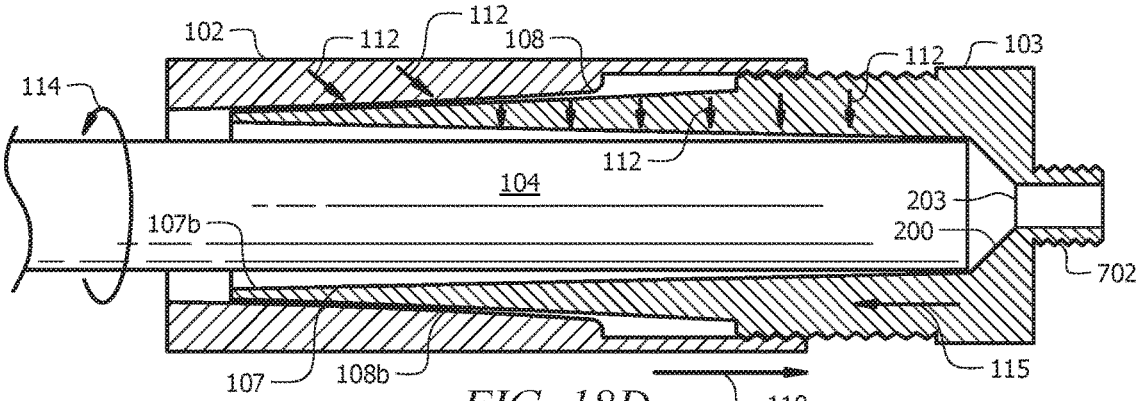
FIG. 18D is a sectional elevation view of an embodiment of the present invention highlighting the internal mechanisms of the adapter with force arrows.

Referring now specifically to FIG. 18*d*, as sheath 102 is rotated in direction 114, the threaded engagement with sheath 103 causes sheath 102 and its integrated compression collar 108 to translate in a linear direction towards the distal end of sheath 103, as depicted by arrow 110. The tapered inner surface 108*b* of compression collar 108 applies a compression force, depicted by arrows 112, which is applied to constricting sleeve 107 and ultimately barrel 104. After a certain amount of rotation of sheath 102, internal surface 107*b* of constricting sleeve 107 will compress into barrel 104, or fitment sleeve 300 if used. Once constricting sleeve 107 and compression collar 108 can no longer move due to the compression force, further rotation of outer sheath 102 in accordance with rotational arrow 114 will force outer sheath 103 to translate in the proximal direction, opposite of the direction of travel of compression collar 108, as depicted by arrow 115. Because outer sheath 103 is in mechanical communication with barrel guide 200, barrel guide 200 will also be pulled in the proximal direction as depicted by arrows 115 until barrel 104 contacts barrel guide 200 to securely aligned barrel 104 with adapter 100. In other words, the adapter is a self-aligning adapter.

Figure 18E:
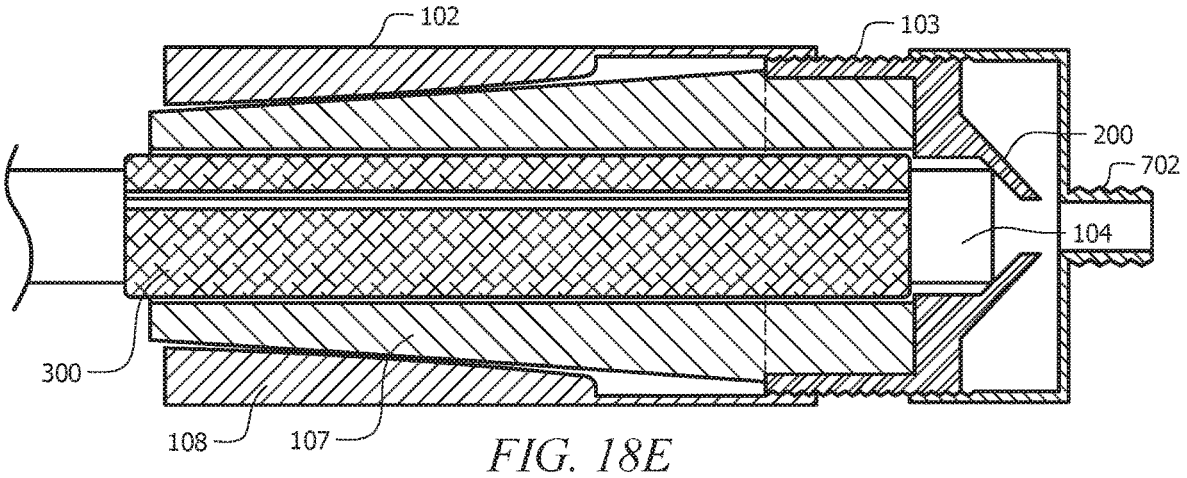
FIG. 18E is a sectional elevation view of an embodiment of the present invention.

Referring now to FIG. 18E, suppressor attachment 702 may be removably attachable to sheath 103, using e.g. the threads on the outer surface of sheath 103. As a result, threaded attachment 702 may be interchangeable with the adapter to account for suppressors with different size threading. This embodiment would be useable with any type of suppressor that relies on a threaded attachment.

Glossary of Claim Terms

Collar: is a structural member having an inner lumen.

Compressible Body: is a body that can change size and/or shape when subjected to a force.

Seal: is a device or substance that is used to join two things together so as to prevent them from coming apart or to prevent anything from passing between them.

Sheath: is an elongated tubular structure.

Sleeve: is a structural member having an inner lumen.

Tubular: means having the form or shape of a hollow, elongated body.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An adapter for a firearm, comprising:

a first sheath and a second sheath, the first sheath being rotatable with respect to the second sheath;

a constricting sleeve residing at least partially within the first sheath being radially integrated into or in mechanical communication with the second sheath, the constricting sleeve including:

a first end and a second end, and a flexible body extending between the first and second ends;

at least a portion of an outer surface tapering, such that a diameter of the outer surface proximate the first end is less than the diameter of the outer surface proximate the second end;

an inner surface having a diameter greater than or equal to an outer diameter of a barrel of the firearm when the adapter is mounted to the barrel of the firearm;

a compression collar radially integrated into or in mechanical communication with the first sheath, the compression collar including:

a first end and a second end;

an inner surface tapering, such that a diameter of the inner surface proximate the first end is less than the diameter of the inner surface proximate the second end;

the constricting sleeve and the compression collar inversely oriented with respect to each other, such that the tapered outer surface of the constricting sleeve increases in diameter in a first direction and the tapered inner surface of the compression collar increases in diameter in the first direction;

a barrel guide in communication with the second sheath, the barrel guide having:

a tapered aperture concentrically aligned with the constricting sleeve, thereby providing a passage for a bullet leaving the barrel of the firearm;

the tapered aperture having a greater diameter at a first end than at a second end, the diameter of the tapered aperture at the first end being greater than the outer diameter of the barrel of the firearm and the diameter of the tapered aperture at the second end being less than the outer diameter of the barrel of the firearm; and whereby an axial force causing the barrel of the firearm to contact the tapered aperture of the barrel guide will funnel the barrel into axial alignment with the aperture.

2. The adapter of claim 1, further including a flexible fitment sleeve having an incomplete circular circumference resulting in an adjustable diameter wherein the flexible fitment sleeve is positioned within the constricting sleeve.

3. The adapter of claim 1, wherein the first end of the constricting sleeve comprises a plurality of flexible arms establishing a discontinuous circumference at the first end of the constricting sleeve, such that the plurality of flexible arms can be moved towards a central longitudinal axis of the constricting sleeve.

4. The adapter of claim 1, further including:

a plurality of slots in the second end of the constricting sleeve establishing a discontinuous circumference at the second end of the constricting sleeve;

a force transferring collar in mechanical communication with the second sheath to prevent rotation between the force transferring collar and the second sheath, the force transferring collar having a plurality of fins extending in an axial direction and residing at least partially within the plurality of slots in the constricting sleeve; and the plurality of fins residing at least partially within the plurality of slots thereby prevents rotation of the constricting sleeve with respect to the force transferring collar and the second sheath.

5. The adapter of claim 1, further comprising a muzzle device mount extending from the second sheath in an axial direction away from the first sheath and in alignment with the aperture in the barrel guide, the muzzle device mount having threads on which a muzzle device can be secured.

6. The adapter of claim 1, wherein the second sheath is axially integrated into a muzzle device or a muzzle device extension.

7. The adapter of claim 1, wherein the constricting sleeve is rotationally fixed with respect to the compression collar.

8. An adapter for a firearm, comprising:

a first sheath and a second sheath, the first sheath being rotatable with respect to the second sheath;

a constricting sleeve residing at least partially within the first sheath, the constricting sleeve including:

a first end and a second end, and a body extending between the first and second ends;

a generally circular cross-section establishing an outer surface and an inner surface, the inner surface having a smaller diameter than the outer surface;

the outer surface tapering, such that a diameter of the outer surface proximate the first end is less than the diameter of the outer surface proximate the second end;

the diameter of the inner surface being greater than or equal to an outer diameter of a barrel of the firearm when the adapter is mounted to the barrel of the firearm;

a compression collar disposed between the constricting sleeve and the first sheath being in threaded communication with the first sheath, the compression collar including:

a first end and a second end;

a circular cross-section establishing an outer surface and an inner surface, the inner surface having a smaller diameter than the outer surface;

the inner surface tapering, such that a diameter of the inner surface proximate the first end is less than the diameter of the inner surface proximate the second end;

the constricting sleeve and the compression collar inversely oriented with respect to each other, such that the tapered outer surface of the constricting sleeve increases in diameter in a first direction and the tapered inner surface of the compression collar increases in diameter in the first direction;

a barrel guide in mechanical communication with the second sheath, the barrel guide having:

a tapered aperture concentrically aligned with the constricting sleeve, thereby providing a passage for a bullet leaving the barrel of the firearm;

the tapered aperture having a greater diameter at a first end than at a second end, the diameter of the tapered aperture at the first end being greater than the outer diameter of the barrel of the firearm and the diameter of the tapered aperture at the second end being less than the outer diameter of the barrel of the firearm; and whereby an axial force causing the barrel of the firearm to contact the tapered aperture of the barrel guide will funnel the barrel into axial alignment with the aperture.

9. The adapter of claim 8, further including a flexible fitment sleeve having an incomplete circular circumference resulting in an adjustable diameter wherein the flexible fitment sleeve is positioned within the constricting sleeve.

10. The adapter of claim 8, wherein the first end of the constricting sleeve comprises a plurality of flexible arms establishing a discontinuous circumference at the first end of the constricting sleeve, such that the plurality of flexible arms can be moved towards a central longitudinal axis of the constricting sleeve.

11. The adapter of claim 8, further including:

a plurality of slots in the second end of the constricting sleeve establishing a discontinuous circumference at the second end of the constricting sleeve;

a force transferring collar in mechanical communication with the second sheath to prevent rotation between the force transferring collar and the second sheath, the force transferring collar having a plurality of fins extending in an axial direction and residing at least partially within the plurality of slots in the constricting sleeve; and the plurality of fins residing at least partially within the plurality of slots thereby prevents rotation of the constricting sleeve with respect to the force transferring collar and the second sheath.

12. The adapter of claim 8, further comprising a muzzle device mount extending from the second sheath in an axial direction away from the first sheath and in alignment with the aperture in the barrel guide, the muzzle device mount having external threads on which a muzzle device can be secured.

13. The adapter of claim 8, wherein the second sheath is axially integrated into a muzzle device or a muzzle device extension.

14. The adapter of claim 8, wherein the constricting sleeve is rotationally fixed with respect to the compression collar.

15. An adapter for a firearm, comprising:

a first sheath and a second sheath, the first sheath being rotatable with respect to the second sheath;

a constricting sleeve in non-rotational communication with the second sheath, the constricting sleeve including:

a first end and a second end, and a compressible body extending between the first and second ends;

at least a portion of the compressible body residing within the first sheath;

at least a portion of an outer surface of the compressible body tapering, such that a diameter of the outer surface proximate to the first end is less than the diameter of the outer surface proximate to the second end;

an inner surface having a diameter greater than or equal to an outer diameter of a barrel of the firearm when the adapter is mounted to the barrel of the firearm;

the first sheath in communication with the constricting sleeve through a tapered structure having an inner diameter proximate a first end that is less than the inner diameter proximate a second end;

the constricting sleeve and the tapered structure inversely oriented with respect to each other, such that the tapered outer surface of the constricting sleeve increases in diameter in a first direction and an inner surface of the tapered structure increases in diameter in the first direction;

a barrel guide concentrically aligned with the constricting sleeve, the barrel guide having:

a tapered aperture concentrically aligned with the constricting sleeve, thereby providing a passage for a bullet leaving the barrel of the firearm;

the tapered aperture having a greater diameter at a first end than at a second end, the diameter of the tapered aperture at the first end being greater than the outer diameter of the barrel of the firearm and the diameter of the tapered aperture at the second end being less than the outer diameter of the barrel of the firearm; and whereby an axial force causing the barrel of the firearm to contact the tapered aperture of the barrel guide will funnel the barrel into axial alignment with the aperture.

16. The adapter of claim 15, further including a flexible fitment sleeve having an incomplete circular circumference resulting in an adjustable diameter wherein the flexible fitment sleeve is positioned within the constricting sleeve.

17. The adapter of claim 15, wherein the first end of the constricting sleeve comprises a plurality of flexible arms establishing a discontinuous circumference at the first end of the constricting sleeve, such that the plurality of flexible arms can be moved towards a longitudinal axis of the constricting sleeve.

18. The adapter of claim 15, further including:

a plurality of slots in the second end of the constricting sleeve establishing a discontinuous circumference at the second end of the constricting sleeve;

a force transferring collar in mechanical communication with the second sheath to prevent rotation between the force transferring collar and the second sheath, the force transferring collar having a plurality of fins extending in an axial direction and residing at least partially within the plurality of slots in the constricting sleeve; and the plurality of fins residing at least partially within the plurality of slots thereby prevents rotation of the constricting sleeve with respect to the force transferring collar and the second sheath.

19. The adapter of claim 15, further comprising a muzzle device mount extending from the second sheath in an axial direction away from the first sheath and in alignment with the aperture in the barrel guide, the muzzle device mount having external threads on which a muzzle device can be secured.

20. The adapter of claim 15, wherein the second sheath is axially integrated into a muzzle device or a muzzle device extension.

* * * * *